US006561895B2

(12) United States Patent
McGill

(10) Patent No.: US 6,561,895 B2
(45) Date of Patent: May 13, 2003

(54) ADJUSTABLE DAMPER FOR AIRFLOW SYSTEMS

(76) Inventor: Joseph A. McGill, 3310 E. Yorba Linda Blvd., #425, Fullerton, CA (US) 92831

( * ) Notice: Subject to any disclaimer, the term of this patent is extended or adjusted under 35 U.S.C. 154(b) by 0 days.

(21) Appl. No.: 10/031,130

(22) PCT Filed: Jan. 30, 2001

(86) PCT No.: PCT/US01/02935

§ 371 (c)(1),
(2), (4) Date: Jan. 8, 2002

(87) PCT Pub. No.: WO02/061346

PCT Pub. Date: Aug. 8, 2002

(65) Prior Publication Data

US 2002/0155806 A1 Oct. 24, 2002

(51) Int. Cl.[7] ..... F24F 7/00
(52) U.S. Cl. ..... 454/298; 454/187
(58) Field of Search ..... 454/298, 187, 454/274, 295, 334; 55/385.2

(56) References Cited

U.S. PATENT DOCUMENTS 2,466,851 A * 4/1949 Honerkamp et al. ..... 454/311
2,822,741 A * 2/1958 Kennedy ..... 454/298
2,923,224 A * 2/1960 Stewart ..... 454/298
3,812,770 A * 5/1974 Morozov ..... 454/285
4,061,082 A * 12/1977 Shuler ..... 454/298
4,397,223 A * 8/1983 Maxson ..... 454/255
4,666,477 A * 5/1987 Lough ..... 96/381
5,207,614 A * 5/1993 Passadore ..... 454/298
5,792,226 A * 8/1998 Lee et al. ..... 55/385.2

* cited by examiner

*Primary Examiner*—Derek Boles
(74) *Attorney, Agent, or Firm*—James G. O'Neill

(57) ABSTRACT

A damper for an air flow system opening, such as the air inlet of a clean room filter module, includes a number of control plates (14, 15) reciprocally mounted on holding elements (22) and a drive element (24, 36) supported from a supporting surface (20) with an airflow opening (21) therein. Gaskets (30, 31) seal around apertures (16, 18) and the airflow opening to allow more accurate and positive control and diffusion, as well as virtually complete shut off, of airflow through the opening. A tool (42) is used to rotate a threaded end (34) of the drive element rotatably held in an opening in a beam (40) by holders (38). The threaded end of the drive element cooperates with an internally threaded opening in a non-round-shaped traveler (36) passing through matching non-round openings in the control plates.

20 Claims, 5 Drawing Sheets

ADJUSTABLE DAMPER FOR AIRFLOW SYSTEMS

FIELD OF THE INVENTION

This invention relates generally to airflow systems, and more particularly, to a damper for regulating and diffusing the airflow through an air inlet to various areas, such as clean room air filter systems.

DESCRIPTION OF RELATED ART

Many types of rooms, such as clean rooms commonly used in many industries, such as the electronic, medical and pharmaceutical industries, use dampers to control airflow to filter systems to reduce the number of particles in the air to specified limitations. In the most common approach, a layer of flat filters is suspended from a room ceiling or a sidewall, with the filters extending over the entire area of the ceiling or sidewall. Air is conducted from a blower through ductwork or a pressurized plenum and then through the filters into an open space in the clean room. The air is returned back to the blower or plenum by way of outlets in the room. The air in the clean room is at an elevated pressure to keep tainted or unfiltered air out. Preferably, airflow into the clean room is controlled by valves or dampers positioned between the blowers or pressurized plenum and the filter elements. Accurate control of the airflow is necessary to maintain desired flow rates and a pressurized clean room. Many attempts have been made to provide for improved control valves or dampers for regulating the airflow into clean rooms.

In U.S. Pat. No. 4,666,477 to Lough, there is described a clean room adjustable damper in which a fixed plate having a plurality of apertures has a movable foam plate having a further plurality of apertures mounted over the fixed plate. Relative movement between the plates moves the apertures into and out of alignment to control the flow of air to the filter element. Movement is obtained by rotating a cam that operates against a cam surface to laterally shift the movable foam plate with respect to the fixed plate.

Other systems are known that also laterally move adjacent plates having aligned openings therein to control the flow of air through clean room filter systems.

However, it is still desirable to provide an improved damper to more accurately and efficiently regulate and diffuse the flow of air from an air inlet into clean rooms and the like.

SUMMARY OF THE INVENTION

The present invention provides an improved damper for clean room filter systems that may be used in a ceiling or sidewall, and which is more efficient, better performing and easier to use. The present invention provides dampers that include a plurality of spaced apart plates that more positively regulate and diffuse airflow, and which allow for virtually complete shut off of airflow. The plurality of spaced-apart plates are supported from a filter lid panel, or other supporting surface, so as to be easily axially translatable from open to closed positions. Each plate member is reciprocally mounted on a support rod or control element, and includes a plurality of non-aligned apertures.

The dampers of the present invention can be utilized with any type of pressurized system, such as ducted, fan powered, or pressure plenum-type systems. All variations may be interchanged or mixed within a filter system. When used with ducted filter modules having hoods or lid panels, the dampers of the present invention are held or supported by the lid panels. Supply air duct work for the ducted filter module variation is attached directly to the upper side of the lid panel of each module, thus making the duct connection independent of the filter element in the module. Each ducted filter module lid panel includes a damper of the present invention at the supply duct connection to diffuse and vary the volume of supply air for balancing and fine-tuning, or to completely shut off the flow of air. The damper includes separate elements operating axially to the air inlet only, for more accurately and positively regulating and diffusing airflow.

It is, therefore, a general object of the present invention to provide an improved damper for airflow systems. It is a particular object of the present invention to provide an improved damper for clean room air filter systems comprised of individual filter modules. It is another particular object of the present invention to provide an improved damper for clean room air filter systems comprised of separate plates having a plurality of non-aligned apertures therein which move axially to the air inlet of the filter modules. It is yet another particular object of the present invention to provide an improved damper for clean room air filter systems that offers virtually complete shut off of airflow to filter modules. It is still a further particular object of the present invention to provide an improved damper for clean room air filter systems that may be activated from the clean room side of the filter system.

These and other objects of the present invention are achieved by providing a damper for air flow systems, which damper has a plurality of axially movable plates supported from a filter module lid, ceiling or other support surface having an air inlet therein. Each axially movable plate has a plurality of apertures therein, which apertures are not aligned, for regulating and diffusing the flow of air blown from an air supply system therethrough. Gaskets cooperate with the movable plates to seal the same, and the damper includes a central rotating drive member to operate the plurality of movable plates between open and closed positions.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein:

DESCRIPTION OF THE PREFERRED EMBODIMENTS

Figure 1:
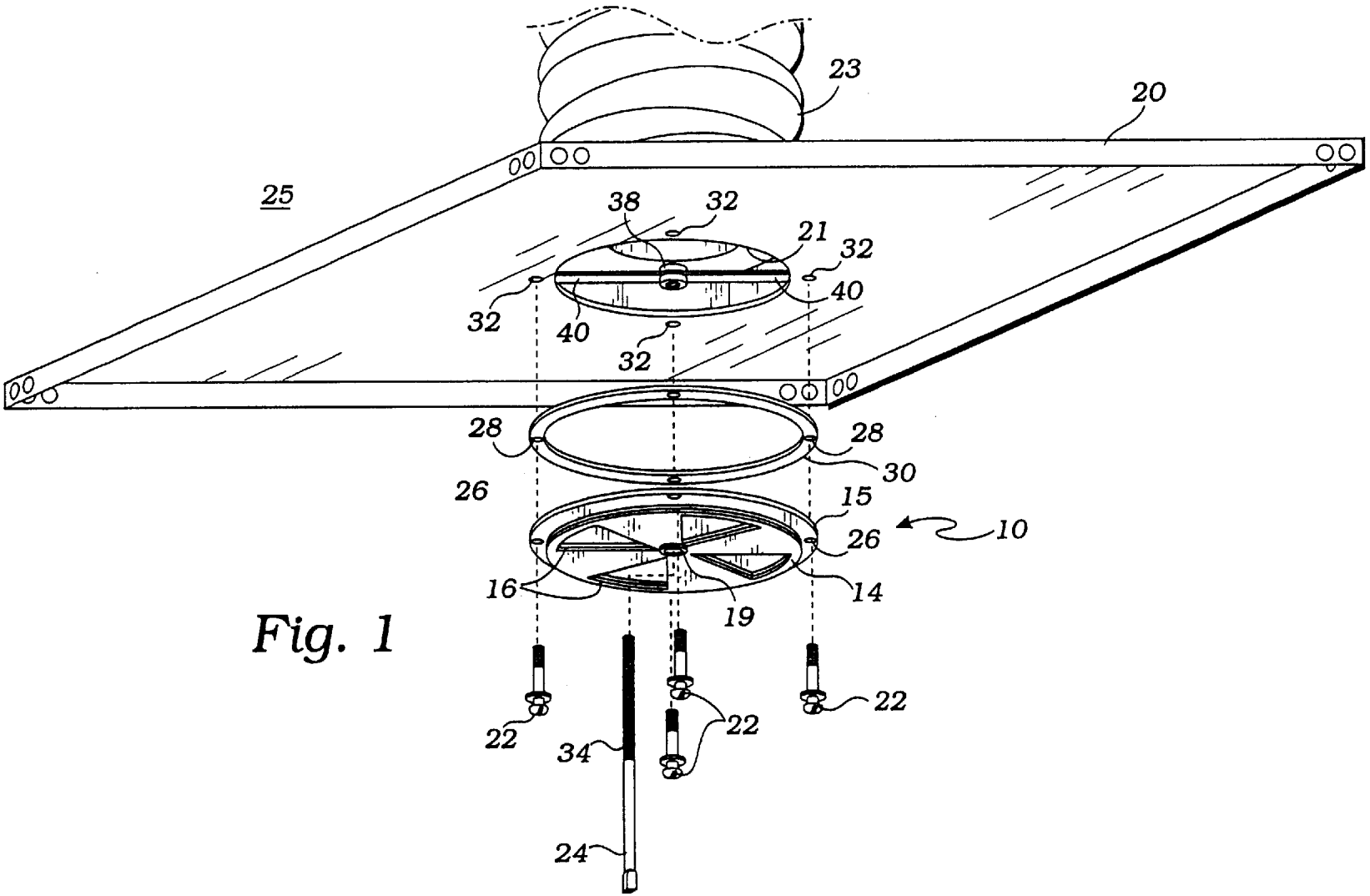
FIG. 1 is an exploded perspective view, showing a damper of the present invention, as used on a ducted filter module.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein to provide for an improved damper for air supply systems and particularly clean room air filter systems, generally indicated at 10, throughout the several views.

As shown in the drawings, a preferred embodiment of the damper 10 is illustrated for use in a modular air filter ceiling system. However, it is to be understood that the damper of the present invention could also be used with other clean room air filter systems, or unfiltered non-clean room systems as well.

Turning first to FIG. 1, there shown is the damper 10 for use in an overhead modular filter system 12 (see FIGS. 5–7), having a plurality of spaced apart, control plates 14, 15. For reasons of explanation only, and not by way of limitation, the control plates 14, 15 are described and shown as being circular and having triangular apertures or openings 16, 18 therein. However, it is obvious that the control plates could be any shape, such as oval or rectangular, and the apertures 16, 18 could be any desired shape, and any number could be used. The control plates 14, 15 are also shown as being suspended from a support surface 20, such as a lid panel, by a plurality of holding elements 22 and a traveler 36, as explained more fully below. The lid panel 20 is supported from a ceiling or other support structure, for example, by support brackets at each corner thereof or fitted to a filter module frame that is otherwise supported. The lid panel 20 includes a central opening 21 for airflow from a duct 23 in an interstitial space 25. The damper 10 controls the flow of air from the air duct 23 or a plenum (not shown) above the lid panel 20.

The control plates 14, 15 may be the same size or may be different sizes. The control plates 14 and 15 are mounted below, or adjacent as the case may be, to the lid panel 20, and include guide or holding elements 22, which pass through openings 26 formed in inner control plate 15 and further openings 28 formed in a sealing gasket 30. The guide or holding elements 22 are captured in openings 32 in lid panel 20, around central opening 21. It is to be understood that other types of guides, holding elements or pins 22 may be substituted for those shown. Traveler 36 (see FIGS. 5–7) is threaded onto a threaded portion 34 of drive element or rod 24, which is rotatably affixed to beam 40, which spans the central opening 21. Holders 38, such as nuts or the like, are pinned or otherwise secured to drive element or rod 24, on either side of beam 40, thereby holding drive element or rod 24 in a rotatable but axially stationary manner. It should be pointed out, however, that, although the drive element or rod 24 preferably remains axially stationary, it could be adapted to be axially translatable.

As shown in FIGS. 2–7, when the damper is mounted or suspended in place, adjacent to or below central opening 21, the inner plate 15 and outer plate 14 are moved axially, toward and away from the central opening, by rotating the drive element 24 in beam 40 and an upper seal 45 in a hollow filter divider 46, by means of a tool 42. The tool 42 is inserted through a lower opening 44 in the hollow filter divider 46 of filter element 12 (see FIGS. 5–7). The tool 42 includes an inner end 48 that cooperates with an outer end of the drive element 24 to allow adjustment of the outer and inner plates 14 and 15 between open and closed positions, to control the flow of air from air duct 23 or from a pressure plenum through central opening 21 and through filter element 12.

Figures 2, 3, 4:
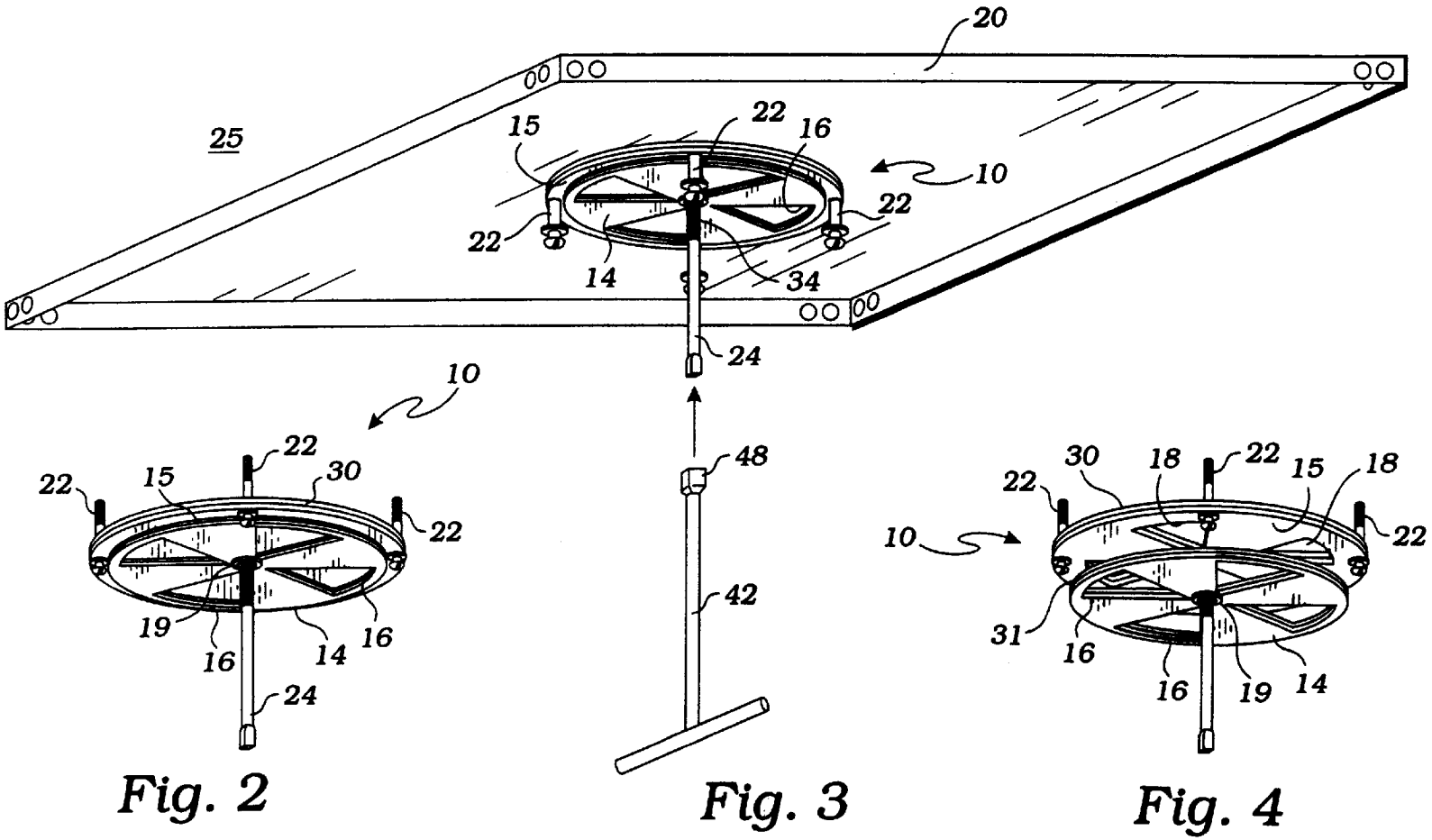
FIG. 2 is a partial perspective view showing the damper of the present invention in a partially closed position.
FIG. 3 is a perspective view showing the damper of the present invention in the closed position, and an operating tool for the damper.
FIG. 4 is a partial perspective view showing the damper of the present invention in the opened position.
Figure 5:
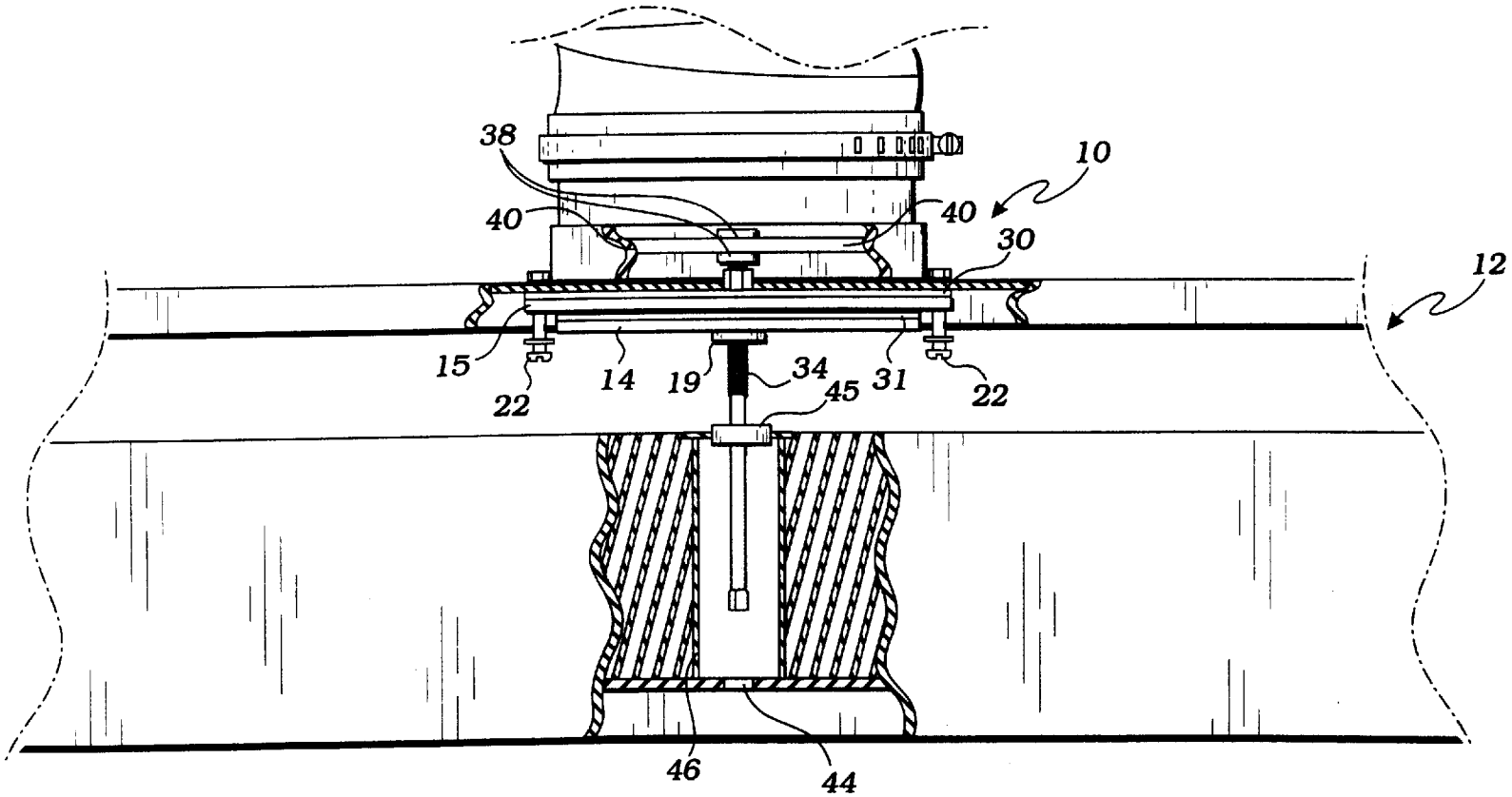
FIGS. 5 through 7 are enlarged partial sectional views of the damper of the present invention mounted in a ducted filter module having a hollow divider, with the damper plates shown in various positions.
Figure 6:
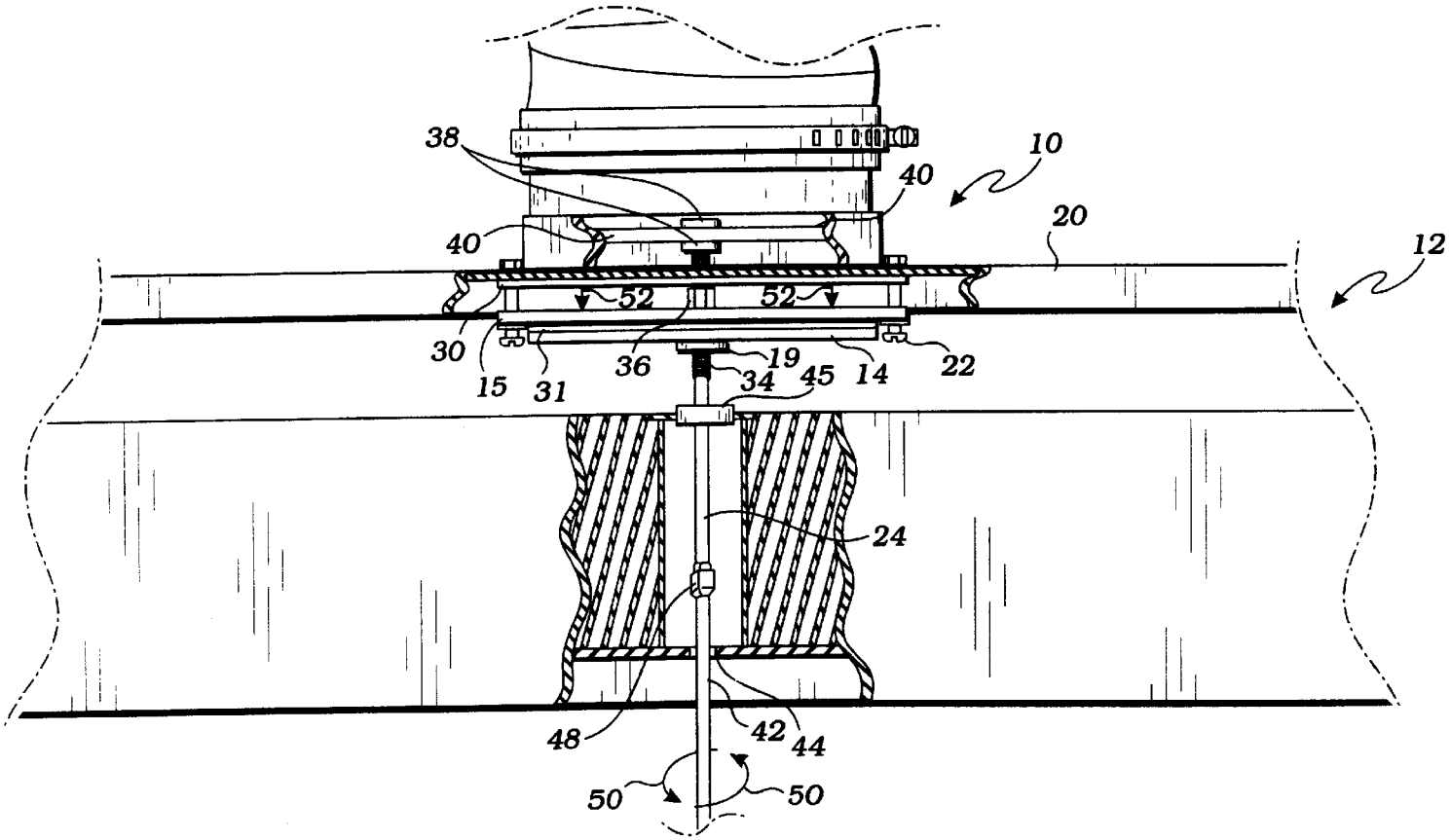

The operation of the damper 10 will now be explained. When the tool 42 is rotated, either clockwise or counterclockwise, as shown by arrows 50 in FIGS. 6 and 7, the drive means will be operated. That is, drive element 24 will be rotated in beam 40 to rotate the threaded portion 34. When the threaded portion 34 of the drive element 24 is rotated, which drive element is axially constrained by the nuts 38, the drive element will rotate in the internal threads of traveler 36, which traveler is preferably non-round and passes through matching non-round central openings in outer and inner control plates 14, 15, to prevent both the control plate 14 and the non-round traveler 36 from rotating. For example, when the outer and inner control plates 14, 15 are closed against gaskets 30 and 31 to seal the central opening 21 and stop airflow, as shown in FIGS. 3 and 5, the control plates may be opened as follows:

The drive element 24 is rotated in seal 45 by tool 42 to allow the inner end of the threaded portion 34 held by nuts 38 to rotate or turn in the opening in beam 40, and allow the traveler 36, which is constrained from turning, to move axially, thereby causing both control plates 14, 15 to move axially, away from lid panel 20 and gasket 30 surrounding central opening 21, in the direction of arrows 52 (see FIG. 6). The inner control plate 15 will not rotate because it is held in position by the guide or holding elements 22 (four of which are shown) passing through openings 26. Additionally, since the outer control plate 14 is supported from and resiliently secured to a washer 19, which washer is secured to the traveler 36, the outer control plate cannot rotate due to the non-round traveler 36 passing through the matching non-round openings formed in both control plates 14, 15.

Figure 7:
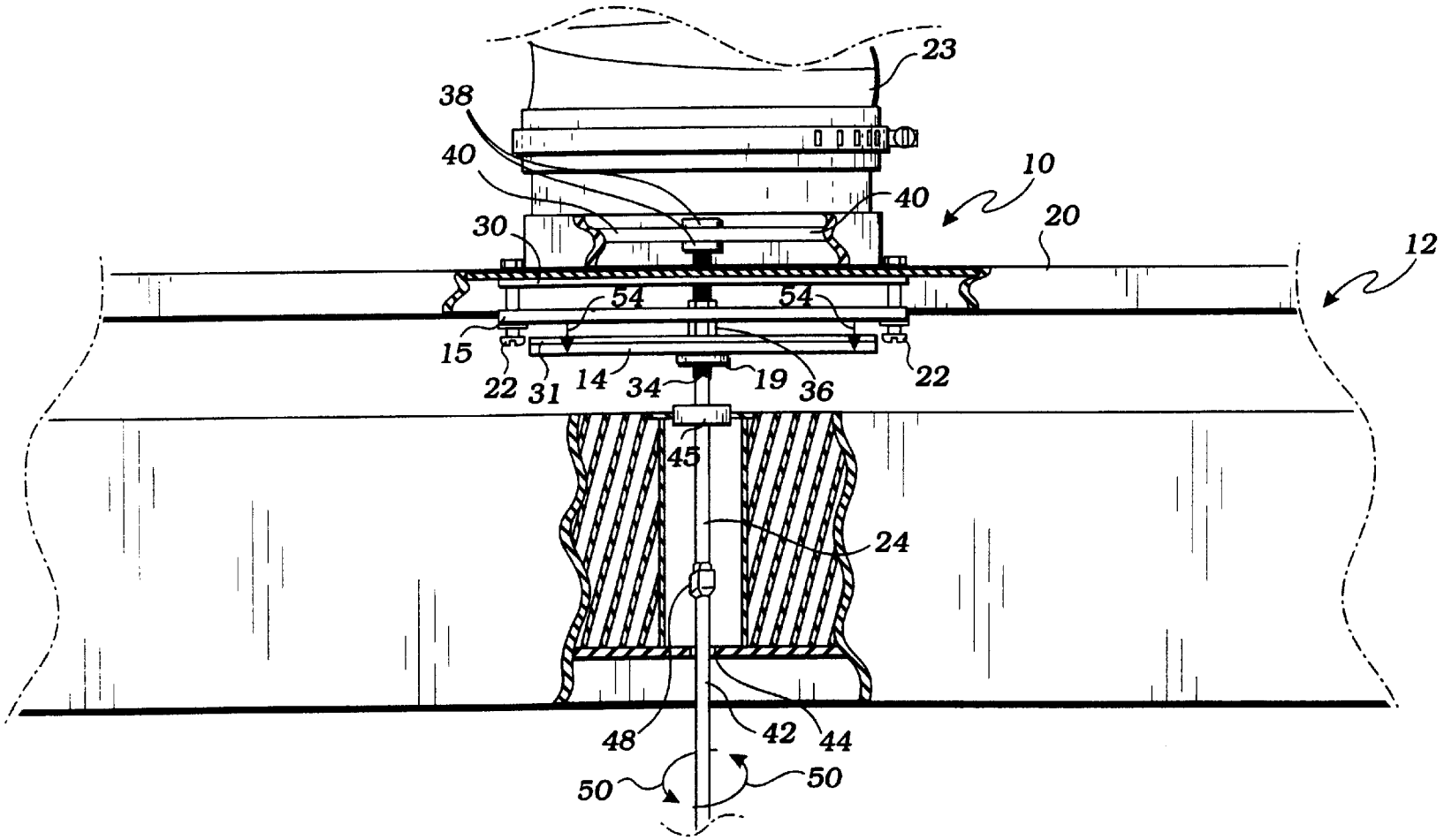

When the inner control plate 15 reaches stops or outer portions of holding elements 22, the inner control plate stops its axial movement, and outer control plate 14 will continue to travel, because of the rotation of the threaded portion 34 of the drive element 24 in the traveler 36, axially away from the upper control plate 15, in the direction of arrows 54 (see FIG. 7). This allows further airflow through the now open, spaced apart offset openings 16, 18.

To fully or partially close the control plates 14, 15, the tool 42 is rotated in the opposite direction, to rotate the threaded portion 34 of the drive element 24 in the traveler 36, in the opposite direction. This will move the traveler 36 and outer plate 14 axially inward, until gasket 31 contacts an outer surface of inner control plate 15 to thereby close the offset openings 16, 18. Further rotation of the threaded portion 34 of the drive element 24 will move the traveler 36 and outer and inner control plates 14, 15 axially until the inner control plate contacts gasket 30 and completely seals off the opening 21.

It, therefore, can be seen that the present invention provides an improved damper for more accurately and positively regulating airflow in air filter systems for clean rooms, and also allows for virtually complete shut off of airflow in the same by the use of two axially movable plates having offset openings formed therein and which include cooperating gaskets to provide a tight seal when the plates are in the closed position.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A damper for an air flow system, characterized in that:

the damper includes a plurality of separate control plates supported from a supporting surface having an airflow opening therein;

each of the plurality of separate control plates include a plurality of offset apertures formed therein;

a first sealing means between one of the plurality of control plates and the supporting surface around a perimeter of the airflow opening;

a second sealing means between the plurality of control plates around outside perimeters of the plurality of offset apertures;

a plurality of spaced supporting elements secured to the supporting surface having the airflow opening therein;

the plurality of spaced supporting elements passing through one of the plurality of control plates; and a drive means for axially moving the plurality of control plates toward and away from each other and the supporting surface, to regulate and diffuse the flow of air through the airflow opening.

2. The damper of claim 1 wherein the drive means includes a rod having a threaded end held rotatably secured in the airflow opening.

3. The damper of claim 1 wherein the supporting surface is a hood of an air filter module for a clean room.

4. The damper of claim 3 wherein the plurality of control plates include an inner plate and an outer plate, with respect to the supporting surface.

5. The damper of claim 4 wherein the first sealing means and the second sealing means are gaskets cooperating with the plurality of control plates.

6. The damper of claim 5 wherein the plurality of control plates are circular, and the offset apertures are triangular shaped.

7. The damper of claim 6 wherein the drive means includes a non-round internally threaded traveler passing through matching non-round apertures in the plurality of control plates.

8. The damper of claim 7 wherein there are two control plates and an outer of the two control plates away from the supporting surface, is supported on and secured to the non-round internally threaded traveler.

9. The damper of claim 8 wherein the rod extends through a sealed opening of a hollow divider of a clean room filter element to allow actuation of the drive means by a cooperating tool from a clean room side of the filter element.

10. The damper of claim 1 wherein the drive means includes a rod having a threaded portion cooperating with in internally threaded non-round traveler passing through matching non-round apertures in the plurality of control plates.

11. The damper of claim 10 wherein there are two control plates comprised of an inner plate and an outer plate, with respect to the supporting surface; the outer plate being supported on and secured to a traveler forming part of the drive means; and the first sealing means and the second sealing means are gaskets cooperating with the inner plate and the outer plate.

12. The damper of claim 11 wherein the inner plate and the outer plate are substantially circular and the offset apertures substantially triangular in shape; and the traveler is internally threaded and non-round in shape and passes through matching non-round apertures formed in the inner plate and the outer plate.

13. The damper of claim 12 wherein the rod extends through a sealed opening of a hollow divider of a clean room filter element to allow actuation of the drive means by a cooperating tool from a clean room side of the filter element.

14. A damper for an air flow system, comprising:

the damper includes a plurality of separate control plates supported from a supporting surface having an airflow opening therein;

each of the plurality of separate control plates include a plurality of offset apertures formed therein;

a first gasket held between one of the plurality of control plates and the supporting surface around a perimeter of the airflow opening;

a gasket held between the plurality of control plates around outside perimeters of the plurality of offset apertures;

a plurality of spaced supporting elements secured to the supporting surface having the airflow opening therein;

the plurality of spaced supporting elements passing through one of the plurality of control plates; and a drive rod connected to a traveler for axially moving the plurality of control plates toward and away from each other and the supporting surface, to regulate and diffuse the flow of air through the airflow opening.

15. The damper of claim 14 wherein the rod has a threaded end rotatably held in the airflow opening, and the traveler is internally threaded and non-round in shape.

16. The damper of claim 15 wherein there are two circular shaped control plates comprised of an inner plate adjacent the supporting surface and an outer plate, away from the inner plate; and the outer plate is supported on and secured to the traveler.

17. The damper of claim 16 wherein the offset apertures are substantially triangular in shape; and the non-round traveler passes through matching non-round apertures formed in the inner plate and the outer plate.

18. The damper of claim 17 wherein the rod extends through a sealed opening of a hollow divider of a clean room filter element to allow actuation of the drive means by a cooperating tool from a clean room side of the filter element.

19. A damper for an air flow system, comprising:

a pair of control plates supported from a supporting surface having an airflow opening therein;

the pair of control plates comprising an inner plate adjacent the supporting surface and an outer plate removed from the inner plate; the inner plate and the outer plate having a plurality of offset apertures formed therein;

a first gasket held between the inner plate and the supporting surface, around a perimeter of the airflow opening;

a second gasket held between the first plate and the second plate around outside perimeters of the plurality of offset aperture.

a plurality of spaced supporting elements secured to the supporting surface having the airflow opening therein;

the plurality of spaced supporting elements passing through the outer plate; and a drive means including a threaded rod and a traveler for axially moving the first plate and the second plate toward and away from each other and the supporting surface, to regulate and diffuse the flow of air through the airflow opening.

20. The damper of claim 19 wherein the supporting surface is a hood of an air filter module for a clean room; the rod extends through a sealed opening of a hollow divider of a clean room filter element to allow actuation of the threaded rod by a cooperating tool from a clean room side of the clean room filter element; and the traveler is non-round and passes through matching non-round apertures formed in the inner plate and the outer plate, and is secured to the outer plate.

* * * * *